US005840458A

United States Patent [19]

Kido et al.

[11] Patent Number: 5,840,458

[45] Date of Patent: Nov. 24, 1998

[54] DEVELOPER FOR DEVELOPING AN ELECTROSTATIC LATENT IMAGE TO WHICH LAMINATED TITANIUM OXIDE IS EXTERNALLY ADDED

[75] Inventors: Kenichi Kido; Katsunori Kurose; Takeshi Arai, all of Amagasaki; Masayuki Hagi, Takatsuki, all of Japan

[73] Assignee: Minolta Co., Ltd., Osaka, Japan

[21] Appl. No.: 600,375

[22] Filed: Feb. 13, 1996

[30] Foreign Application Priority Data

| | | | |
|---|---|---|---|
| Feb. 14, 1995 | [JP] | Japan | 7-025247 |
| Feb. 14, 1995 | [JP] | Japan | 7-025248 |
| Feb. 14, 1995 | [JP] | Japan | 7-025251 |
| Feb. 14, 1995 | [JP] | Japan | 7-025439 |
| Dec. 11, 1995 | [JP] | Japan | 7-321591 |

[51] Int. Cl.[6] ..... G03G 9/087; G03G 9/08

[52] U.S. Cl. ..... 430/110; 430/106.6; 430/109; 430/111; 430/903

[58] Field of Search ..... 430/110, 109, 430/111, 903, 106.6, 108

[56] References Cited

U.S. PATENT DOCUMENTS

| | | | |
|---|---|---|---|
| 4,557,991 | 12/1985 | Takagiwa et al. | 430/109 |
| 4,623,605 | 11/1986 | Kato et al. | 430/110 |
| 4,652,509 | 3/1987 | Shirose et al. | 430/110 |
| 4,904,558 | 2/1990 | Nagatsuka et al. | 430/122 |
| 5,060,021 | 10/1991 | Yamamoto et al. | 430/903 |
| 5,155,000 | 10/1992 | Matsumura et al. | 430/110 |
| 5,212,039 | 5/1993 | Demizu et al. | 430/122 |
| 5,272,040 | 12/1993 | Nakasawa et al. | 430/110 |
| 5,350,657 | 9/1994 | Anno et al. | 430/111 |
| 5,557,372 | 9/1996 | Ojima et al. | 355/219 |
| 5,604,071 | 2/1997 | Okado et al. | 430/110 |

FOREIGN PATENT DOCUMENTS

| | | |
|---|---|---|
| 60-112052 | 6/1985 | Japan . |
| 4-204748 | 7/1992 | Japan . |

OTHER PUBLICATIONS

English–Language Translation of *Technical Bulletin Aerosil®,* Aluminum Oxide C and Titanium Dioxide P25 Produced by Aerosil Process No. 15, Nippon Aerosil, K.K. (Jan. 1994) pp. 1, 3, 5–7, 13, 14, 31, 35.

Patent & Trademark English–Language Translation of JP 4–204748 (Pub Jul. 1992).

Patent & Trademark English–Language Translation of JP 60–112052 (Pub Jun. 1985).

Caplus Abstract AN: 1993: 30004 (1993) of JP 04204748 (Pub Jul. 1992).

WPIDS Abstract AN: 92–296372 (1992) of JP 04204748 (Pub Jul. 1992).

*Primary Examiner*—Janis L. Dote

*Attorney, Agent, or Firm*—McDermott, Will & Emery

[57] ABSTRACT

The present invention relates to a developer comprising toner to which laminated titanium oxide is externally added.

34 Claims, 2 Drawing Sheets

DEVELOPER FOR DEVELOPING AN ELECTROSTATIC LATENT IMAGE TO WHICH LAMINATED TITANIUM OXIDE IS EXTERNALLY ADDED

BACKGROUND OF THE INVENTION

1. Field of the Invention

The present invention relates to a developer for developing electrostatic latent images in electrophotography, electrostatic recording, electrostatic printing, and the like.

2. Description of the Related Art

In the image forming processes of electrophotography, electrostatic recording, electrostatic printing, and the like, in which an image is formed through steps of forming an electrostatic latent image on the surface of a photoconductive material and developing the electrostatic latent image, such characteristics are of importance for the developer as preservability (anti-blocking property), carriability, developability, transferability, chargeability, and fixability.

One method for improving these characteristics is, as is already known, to externally add an additive to the toner. For example, several Japanese Patent Laid-Open Publications disclose techniques of adding, to the developer, hydrophobic silica fine particles in the Publication No. SHO 62-113158, titanium oxide fine particles in SHO 64-62667, and fluororesin fine particles in HEI 3-45978. Also, Japanese Patent Laid-Open Publication No. HEI 6-208241 discloses a technique of using titanium oxide of needle-like shape other than ordinary spherical- or indefinite-shape particulate additives.

However, when additives as described in the above laid-open publications are used, there have been disadvantages that increase in toner chargeability occurs under environments of low temperature and low humidity, or that reduction in toner particle size incurs lower image density and deteriorated durability. Further, the toner fluidity would largely vary with environmental variations, so that stable chargeability, transportability, or developability could no longer be obtained, resulting in deteriorated image quality as another disadvantage.

Generally, an additive is, after added to the toner, adhered to toner particle surfaces by van der Waals force through stirring, mixing, or other processes.

However, conventionally known additives, such as those described in the above laid-open publications, are not only difficult to disperse uniformly on the toner surface but also liable to agglomeration of additives themselves that are not adhered to the toner surface, as a further disadvantage. It is difficult to prevent the agglomerations from being liberated, so that the triboelectric charging level of the toner becomes unstable. This would cause the image density to vary, resulting in more fogged images or faulty image quality after continuous copying operations, disadvantageously. Further, carrier spent and the like also would occur due to the separation of the agglomerations. Even if needle-shaped titanium oxide is used, indeed the adhesion to toner can be improved to some extent, but the area of its contact surface with toner is such small that the aforementioned disadvantages could not be obviated.

The above problems have been more apparent in one-component developers to be used for one-component development, particularly those described in U.S. Pat. Nos. 3,731,146 and 2,811,465, in which a thin layer of charged toner is formed on a sleeve when toner particles are passed through a clearance between the sleeve and a blade which is provided in press contact with the sleeve.

Furthermore, when full-color development is involved, high development efficiency as well as good fluidity characteristic are of greater importance, so that fluidizing agents to be externally added to the full-color toner are required to be increased in amount. Also, since the full-color development is implemented by superimposing a plurality of color images formed with a plurality of color toners of red, blue, yellow, and so on, it is necessary for the toners of individual colors to be electrically charged to a specified level at all times without being affected by environments, that is, the environmental stability characteristic in particular is under a strict demand. As a result, the aforementioned problems have been more apparent.

SUMMARY OF THE INVENTION

An object of the present invention is to provide a novel, useful developer for developing an electrostatic latent image, by which the aforementioned problems have been solved.

Another object of the present invention is to provide a developer for developing an electrostatic latent image, which is less affected by environments such as temperature and humidity, and which keeps always stable in chargeability and development characteristics.

A further object of the present invention is to provide a developer for developing an electrostatic latent image, which is prevented from carrier spent, which allows fog-free clear images to be obtained, and which is superior in stable durability.

A further object of the present invention is to provide a developer for developing an electrostatic latent image, which allows excellent color images to be obtained.

A further object of the present invention is to provide a novel, useful one-component developer for developing an electrostatic latent image.

In order to achieve the above objects, a developer of the present invention comprises:

- a toner particle comprising a colorant and a binder resin; and
- a laminated titanium oxide particle adhered to the surface of the toner.

Also, in order to achieve the above objects, a developer of the present invention comprises:

- a toner particle comprising a colorant and a polyester resin having a number average molecular weight (Mn) of 3,000 to 10,000, a weight average molecular weight (Mw) of 7,000 to 50,000, a molecular weight distribution (Mw/Mn) of 1.5 to 5.0, a glass transition point of 50° to 70° C. and a softening point of 90° to 110° C.; and
- a laminated titanium oxide particle adhered to the surface of the toner.

Further, in order to achieve the above objects, a one-component developer of the present invention comprises:

- a toner particle comprising a colorant and a binder resin; and
- a laminated titanium oxide particle adhered to the surface of the toner.

Still also, in order to achieve the above objects, a developer of the present invention comprises:

- a toner particle comprising a colorant and a binder resin;
- a first external additive comprising a laminated titanium oxide particle; and
- a second external additive.

These and other objects, advantages and features of the invention will become apparent from the following description thereof taken in conjunction with the accompanying drawing which illustrates specific embodiment of the invention.

DESCRIPTION OF THE PREFERRED EMBODIMENTS

Figure 1:
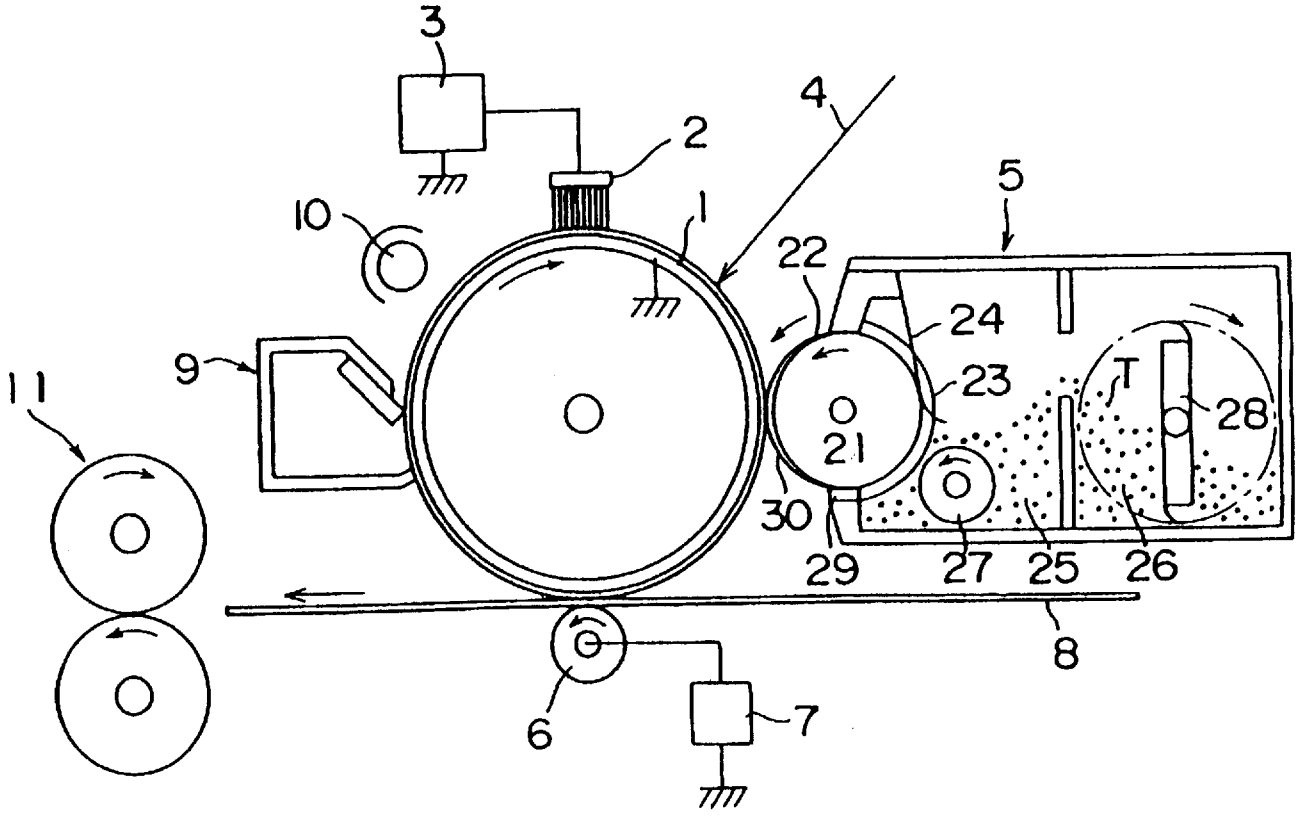
FIG. 1 is a sectional view of a one-component developing apparatus.

A preferred embodiment of the present invention is a developer in which laminated titanium oxide is externally added to a toner particle comprising a colorant and a binder resin.

The titanium oxide externally added to the toner particle is laminated, in other words, flat- or plate-shaped, having a different shape from that of conventionally known spherical-shaped titanium oxide and indefinite-shape particulate titanium oxide.

Laminated titanium oxide is extremely good at adhesion and dispersion to toner by virtue of its unique shape, so that the fine particles adhered to the toner are much unlikely to separate off. As a result, carrier spent can be prevented effectively, and a stable chargeability can be obtained while the durability performance is improved. Also, the good dispersability gives a large surface modification effect of toner, while it leads to successful results in toner fluidity improvement as well as in environmental stability of toner chargeability. In addition, a particularly preferable titanium oxide is titania.

The laminated titanium oxide can be prepared by wet process, and preferably has a mean particle size of 5 to 40 nm, more preferably 5 to 30 nm. It is desirable to use those the fine particle surfaces of which are made hydrophobic in an aqueous system, or further made hydrophobic in a vapor phase. It is noted that the mean particle size of laminated titanium oxide herein refers to an average value of major diameters of particles measured with electron microscope photographs.

In the hydrophobic treatment in an aqueous system, mechanical force is applied to disperse titanium fine particles in primary particles. Therefore, coupling agents having such high reactivity as to yield gaseous sub-products, like chlorosilanes or disilazanes, are not necessarily required to be used, but such high-viscosity hydrophobic-treatment agents as could not be used in a vapor phase because of the agglomeration of titanium oxide particles themselves are also usable.

Consequently, coupling agents, oils, varnishes, organic compounds, and the like may be used as the hydrophobic-treatment agent.

Preferably usable coupling agents are, for example, silane coupling agents, titanium coupling agents, and the like. Particularly preferably usable are silane coupling agents represented by the general formula:

$$R_1m_1SiY_1n_1$$

[wherein $R_1$ denotes an alkoxy group, $m_1$ denotes an integer of 1 to 3, $Y_1$ denotes a hydrocarbon group including alkyl, vinyl, glycidoxy, and methacrylic groups, and $n_1$ denotes an integer of 1 to 3], and exemplified by vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethylmethoxysilane, dimethyldiethoxysilane, trimethylmethoxysilane, hydroxypropyltrimethoxysilane, phenyltrimethoxysilane, n-hexadecyltrimethoxysilane, n-octadecyltrimethoxysilane, and the like.

The amount of coupling agents used is preferably 1 to 40 parts by weight, preferably 3 to 30 parts by weight, on the basis of 100 parts by weight of titanium fine particles.

As silicone oil used for the hydrophobic treatment of titanium oxide, usable are, for example, dimethylpolysiloxanes represented by the following general formula:

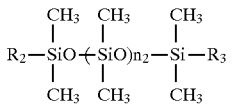

[wherein $R_2$ and $R_3$ are $CH_3$ or OH],
methylhydrogenpolysiloxanes represented by the following general formula:

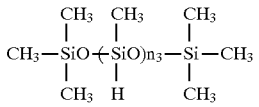

methylphenylpolysiloxanes represented by the following general formula:

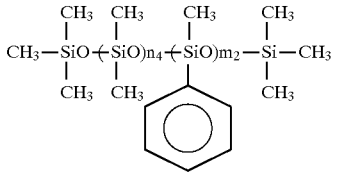

and the like. Further, as required, such processes as alkyl modification, amino modification, epoxy modification, epoxy-polyether modification, carboxyl modification, mercapto modification, alcohol modification, and fluorine modification may be carried out.

Silane coupling agents used to treat, in a vapor phase, the titanium fine particles treated in an aqueous solvent are exemplified by those represented by the following general formula:

$$R_4m_3SiY_2n_5$$

[in which $R_4$ denotes an alkoxy group or a chlorine atom, $m_3$ denotes an integer of 1 to 3, $Y_2$ denotes a hydrocarbon group including alkyl, vinyl, glycidoxy, and methacrylic groups, and $n_5$ denotes an integer of 3 to 1]. Specific examples of them are dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, dimethylvinylchlorosilane, and the like.

The silane coupling agent treatment of the titanium oxide fine particle may be, for example, a wet process in which the fine particle clouded by stirring or the like is reacted with a vaporized silane coupling agent.

Meanwhile, when a plurality of types of external additives including laminated titanium oxide are used, it is no longer necessary to add a large amount of titanium oxide in order to impart sufficient fluidity to the toner, and moreover carrier spent due to the separation of titanium oxide particles can be prevented effectively. Also, because a large amount of titanium oxide is not added, the fluidity and environmental durability of titanium oxide are maintained for long periods while its chargeability to the toner can be ensured enough.

As additives that may be added besides the laminated titanium oxide, usable are fluidizing agents such as silica fine particles, titanium dioxide fine particles, alumina fine particles, magnesium fluoride fine particles, silicon carbide fine particles, boron carbide fine particles, titanium carbide fine particles, zirconium carbide fine particles, boron nitride fine particles, titanium nitride fine particles, zirconium nitride fine particles, magnetite fine particles, molybdenum disulfide fine particles, aluminium stearate fine particles, magnesium stearate fine particles, zinc stearate fine particles, and the like.

These fine particles to be added besides the laminated titanium oxide are preferably subjected to hydrophobic-treatment with silane coupling agents, titanium coupling agents, higher fatty acids, silicone oil, or the like before use.

Also, various types of organic fine particles, such as styrenic, acrylic, and methacrylic ones as well as benzoguanamine, silicone, teflon, polyethylene, and polypropylene, which have been granulated by a wet polymerization process such as emulsion polymerization, soap-free emulsion polymerization, and nonaqueous dispersion polymerization, or by a vapor phase process, may be used singly or in combination.

The addition of fluidizing agents such as silica and alumina is effective in fluidity improvement. The addition of highly triboelectrically chargeable substances such as silica contributes to improvement in the charging level of toner. Further, large-diameter silica, resin beads, and the like serve as spacers, contributing to improvement in developability and transferability.

The concept of the invention as described above may be applied to any developer only if it is to be used with fluidizing agents externally added to the toner particles. For example, they may be applied to developers that are used in image forming apparatus capable of fast image formation, developers that are used in image forming apparatus having the so-called oilless fixing function, in which silicone oil as a releasing agent is not applied to the fixing member that contacts and fixes a toner image formed on paper, developers using magnetic toner, or developers using color toners for full-color image formation. Also, they may be used as either a one-component developer or a two-component developer together with a carrier.

As the color toner for full-color image formation, preferably used are toner particles with a mean particle size of 6 to 10 $\mu$m. Particularly for reproduction of high definition images, toner particles with a mean particle size of 5 to 9 $\mu$m, more strictly 5 to 8 $\mu$m, are used. When used as a one-component developer, toner particles preferably have a mean particle size of 6 to 14 $\mu$m, more preferably 6 to 9 $\mu$m.

Such toner particles are prepared as a particle in which a colorant, such as carbon black, and other desired additives are dispersed in a binder resin. In particular, for color toners for use of full-color image formation, it is preferable to use toner particles incorporating cyan, magenta, yellow, or other colorants.

Usable as the binder resin of the toner are, for example, thermoplastic resins such as polystyrenic resins, poly(meth) acrylic resins, polyolefin resins, polyamide resins, polycarbonate resins, polyether resins, polysulfonic resins, polyester resins, epoxy resins, and butadiene resins, thermosetting resins such as urea resins, urethane resins, and epoxy resins, and besides copolymers, block polymers, graft polymers and polymer blends of these resins. The binder resin is not limited to those in perfect polymer state such as thermoplastic resins, but those containing oligomers or prepolymers, cross-linking agents, and the like such as in thermosetting resins may also be used.

When the developer is used for image forming apparatus that implement fast image formation, it is necessary to fix the toner on the transfer paper in short time or to enhance its separability from the fixing roll. Therefore, the binder resin to be used is preferably a homopolymer or copolymer synthesized from styrenic monomers, (meth)acrylic monomers, or (meth)acrylate monomers, or a polyester resin.

For the binder resin to be used, a number average molecular weight Mn and weight average molecular weight Mw are preferably such that $1000 \leqq Mn \leqq 10000$ and $20 \leqq Mw/Mn \leqq 70$, and that $2000 \leqq Mn \leqq 7000$.

Further, when the developer is used for image forming apparatus that implement oilless fixing, it is preferable to use a binder resin having a glass transition point of 55° to 80° C. and a softening point of 80° to 150° C. and containing 5 to 20% by weight of gelling components.

The resin used as a binder for color toner for use of full-color image formation is preferably epoxy resins or polyester resins, and particularly preferably, among others, polyester resins highly negatively chargeable and superior in fixability. Also, those having a sharp melting characteristic are preferable, and most suitable are polyester resins the diol component of which is given by a bisphenol derivative or substitute and has been condensation copolymerized with a carboxylic acid component such as fumaric acid, maleic acid, maleic anhydride, phthalic acid, terephthalic acid, trimellitic acid, or other acids composed of divalent or higher carboxylic acid or its acid anhydrides or lower alkylesters.

The resin, when used as a binder resin for color toner for full-color image formation, is further preferably a linear polyester resin having a number average molecular weight (Mn) of 3,000 to 10,000, preferably 3,000 to 7,000, a weight average molecular weight (Mw) of 7,000 to 50,000, preferably 7,000 to 15,000, a molecular weight distribution (Mw/Mn) of 1.5 to 5.0, preferably 2.0 to 4.0 by molecular weight distribution measurement with gel permeation chromatography (GPC), an endothermic peak value (Tg) of 50° to 70° C. by DSC, and a softening point (Tm) of 90° to 110° C. by flow tester. Actually, given a molecular weight distribution in the aforementioned range, toner's sharp-melting characteristic in fixing process can be enhanced so that the light-transmittancy can be enhanced. Also, given a glass transition point and a softening point in the aforementioned ranges, the toner can be provided with sufficient thermal resistance and fixability.

The polyester resin contains substantially no components insoluble to tetrahydrofuran and therefore is soluble to tetrahydrofuran. Some components insoluble to tetrahydrofuran, if contained, would make a cause of blocking the light-transmittancy of the toner, undesirably.

Further, when the toner is used as a full-color toner, a linear polyester resin having a glass transition point of 55° to 70° C., a softening point of 80° to 150° C., an Mn of 2,000 to 15,000, and a molecular weight distribution Mw/Mn of 5 or less is used as the binder resin.

Also preferably usable are linear urethane modified polyesters obtained by reacting di-isocyanate with the aforementioned linear polyester resin, or resins obtained by modifying the aforementioned linear polyester resin with styrenic, acrylic, amino-acrylic monomers by graft polymerization, block polymerization, and the like.

Examples of the binder resin used as a one-component developer include various kinds of thermoplastic resins which have been used as a binder resin for a one-component developer, for example, polystyrene, styrene copolymers such as styrene/butadiene copolymers, styrene/acryl copolymers, and the like, polyethylene, polyethylene copolymers such as ethylene/vinyl acetate copolymers, ethylene/vinyl alcohol copolymers and the like, phenolic resins, epoxy resins, acryl phthalate resins, polyamide resins, polyester resins, maleic resins and the like. The method of preparation of these resins is not restricted.

Among the above exemplified binder resins polyester resins having a glass transition point (Tg) of 60° to 80° C., and a softening point (Tm) of 110° to 170° C. by a flow tester, and containing 10 to 40% by weight of a insoluble component (gel component) are preferable in view of thermal resistance, fixability, chargeability, and toughness.

In case that the glass transition point is lower than 60° C. or the softening point is lower than 110° C., an obtained toner is deteriorated in the thermal resistance, and the toner tends to adhere on a regulation part of thin toner layer. In case that the glass transition point is higher than 80° C., and the softening point is higher than 170° C., the fixability of the obtained toner becomes worse.

If the amount of the insoluble component exceeds 40% by weight, the fixability of the obtained toner is worse, and if less than 10% by weight, the toughness of the toner becomes insufficient. Particularly, when the insoluble component contains resins having a molecular weight of 1,000,000 or more, the advantageous effect of the present invention is more significant.

As the colorant, various types of colorants are usable. Blue dyes and pigments may be typically exemplified by C. I. 74100 (metal-free phthalocyanine blue), C. I. 74160 (phthalocyanine blue), C. I. 74180 (fast sky blue), and the like.

Red dyes and pigments may be typically exemplified by C. I. 12055 (Sterling I), C. I. 12075 (permanent orange), C. I. 12175 (lithol fast orange 3GL), C. I. 12305 (permanent orange GTR), C. I. 11725 (Hansa yellow 3R), C. I. 21165 (vulcan fast orange GG), C. I. 21110 (benzidine orange G), C. I. 12120 (permanent red 4R), C. I. 1270 (para red), C. I. 12085 (fire red), C. I. 12315 (brilliant fast scarlet), C. I. 12310 (permanent red F2R), C. I. 12335 (permanent red F4R), C. I. 12440 (permanent red FRL), C. I. 12460 (permanent red FRLL), C. I. 12420 (permanent red F4RH), C. I. 12450 (light fast red toner B), C. I. 12490 (permanent carmine FB), C. I. 15850 (brilliant carmine 6B), and the like.

Yellow dyes and pigments may be typically exemplified by C. I. 10316 (naphthol yellow S), C. I. 11710 (Hansa yellow 10G), C. I. 11660 (Hansa yellow 5G), C. I. 11670 (Hansa yellow 3G), C. I. 11680 (Hansa yellow G), C. I. 11730 (Hansa yellow GR), C. I. 11735 (Hansa yellow A), C. I. 11740 (Hansa yellow RN), C. I. 12710 (Hansa yellow R), C. I. 12720 (pigment yellow L), C. I. 21090 (benzidine yellow), C. I. 21095 (benzidine yellow G), C. I. 21100 (benzidine yellow GR), C. I. 20040 (permanent yellow NCG), C. I. 21220 (vulcan fast yellow 5), C. I. 21135 (vulcan fast yellow R), and the like.

Black pigments may be carbon black, copper oxide, manganese dioxide, aniline black, activated carbon, ferrite, magnetite, and the like.

These colorants may be used singly or in combination in some pluralities among them, whereas it is desirable to use the colorants in an amount of 1 to 10 parts by weight, preferably 2 to 5 parts by weight, on the basis of 100 parts by weight of binder resins contained in the toner particle. If the than 10 of colorants is more than 10 parts by weight, the fixability and light-transparency of toner may deteriorate. Conversely, if it is less than 1 part by weight, there is a possibility that a desired image density cannot be obtained.

If desired, additives such as charge controlling agents and offset inhibiting agents may be further added to the toner particle.

The charge controlling agent may be either positive charge controlling agents or negative charge controlling agents.

The positive charge controlling agents are, for example, nigrosine base EX, Bontron N-01, 02, 04, 05, 07, 09, 10, and 13 (made by Orient Kagaku Kogyo K.K.), Oil Black (made by Chuo Gosei Kagaku K.K.), quaternary ammonium salt P-51 (made by Orient Kagaku Kogyo K.K.), polyamine compound P-52 (made by Orient Kagaku Kogyo K.K.), Sudan Chief Schwaltz BB (Solvent Black 3; C. I. No. 26150), Fett Schwaltz HBN (C. I. No. 26150), Brilliant Spirit Schwaltz TN (made by Farbenfabriken Bayer GmbH), alkoxylated amine, alkylamide, molybdic acid chelate pigments, PLZ1001 (made by Shikoku Kasei Kogyo K.K.), and other imidazole compounds.

The negative charge controlling agent may be, for example, Bontron S-22 (made by Orient Kagaku Kogyo K.K.), Bontron S-34 (Orient Kagaku Kogyo K.K.), Bontron E-81 (Orient Kagaku Kogyo K.K.), Bontron E-84 (Orient Kagaku Kogyo K.K.), Spilon Black TRH (Hodogaya Kagaku Kogyo K.K.), or other metal complexes; thioindigo pigments, copy charge NX VP-434 (made by Hoechst Co.) or other quaternary ammonium salts; Bontron E-89 (Orient Kagaku Kogyo K.K.) or other calix arene compounds; magnesium fluoride, carbon fluoride, and other fluoride compounds. In addition, metal complexes that can be used as a negative charge controlling agent include those having various structures, other than the above, such as oxycarbonic acid metal complexes, dicarbonic acid metal complexes, amino acid metal complexes, diketone metal complexes, diamine metal complexes, azo-group containing benzene—benzene derivative frame metal complexes, and azo-group containing benzene—naphthalene derivative frame metal complexes.

Particularly for use as a developer for full-color image formation, it is preferable to use negative charge controlling agents such as E-81 (made by Orient Kagaku Kogyo K.K.) and other chromium complexes, E-84 (made by Orient Kagaku Kogyo K.K.) and other zinc complexes, E-86 (made by Orient Kagaku Kogyo K.K.) and other aluminium complexes, and E-89 (made by Orient Kagaku Kogyo K.K.) and other calix arene compounds.

The charge controlling agents should be controlled in its addition amount depending on the type of toner, as required. Usually, it is desirable to use 0.01 to 10 parts by weight of charge controlling agents on the basis of 100 parts by weight of the binder resin of the toner. Also, the charge controlling agent may be fixedly adhered to the toner surface. When fixedly adhered to the toner surface, the charge controlling agent may be added in a smaller amount than that of dispersion type in the particles, for example, in an amount of about 0.05 to 2 parts by weight.

The offset inhibiting agent to be used may be low molecular weight polyethylene wax, low molecular weight oxidation type polyethylene wax, low molecular weight polypropylene wax, low molecular weight oxidation type polypropylene waxes, and other polyolefinic waxes; higher fatty acid wax, higher fatty acid ester wax, Fischer-Tropsch wax, Candelilla wax, Carnauba wax, and their mixtures.

The offset inhibiting agent, differing depending on the type of toner, is preferably added in a range of 0.1 to 10 parts by weight, preferably 1 to 6, more preferably 2 to 5 parts by weight, on the basis of 100 parts by weight of the binder resin.

The aforementioned binder resin and colorant in combination, as required, with additives such as charge controlling agents and offset inhibiting agents are kneaded, pulverized, and classified, to give a toner particle.

As a means for externally adding laminated titanium oxide or other desired additives to the toner particle, conventionally known mechanical pulverizing and mixing methods or the like may be adopted. For example, mixers such as Henschel mixer, super mixer, powder mixer, and homogenizer, may be used.

Whereas the addition amount of the laminated titanium oxide should be selected properly depending on the type of toner, the laminated titanium oxide is preferably added and mixed within a range of 0.3 to 2.0% by weight relative to toner. If the addition amount is less than 0.3% by weight, desired fluidity and environmental properties might not be obtained, resulting in deteriorated image quality. Also, if it exceeds 2.0% by weight, the charging level would be deteriorated, causing fogs or the like. In particular, when the developer is used for full-color image formation, the laminated titanium oxide is preferably added and mixed in an amount of 0.5 to 2.0% by weight, more preferably 0.5 to 1.5% by weight, to the toner. When the developer is used as a one-component developer, the laminated titanium oxide is preferably added and mixed in an amount of 0.3 to 1.7% by weight, more preferably 0.5 to 1.5% by weight, to the toner. Further, when two or more kinds of external additives are used, the laminated titanium oxide is externally added, preferably, in an amount of 0.3 to 1.5 parts by weight, more preferably 0.4 to 1.2 parts by weight, on the basis of 100 parts by weight of toner particles. The total amount of laminated titanium oxide and other additives is preferably 0.4 to 3 parts by weight, more preferably 0.4 to 2 parts by weight, on the basis of 100 parts by weight of toner particles.

If the total addition amount is less than 0.4 parts by weight, there is a possibility that the effect of using additives other than laminated titanium oxide may be insufficient. Conversely, if the total addition amount exceeds 3 parts by weight, it may cause black spots (black-dot-like adherence of the toner component to photoconductor).

When the developer is used as a two-component developer, various types of developers known as a carrier such as iron powder or other metals and their oxides, a ferrite carrier, a binder type carrier, a coated carrier, and the like may be used. As a full-color carrier, among others, the coated carrier is particularly preferable. As the core material of coated carrier, it is preferable to use one having a mean particle size in a range from at least 20 $\mu$m, with a view to preventing carrier adhesion (scattering) onto the electrostatic latent image carrier, to at most 100 $\mu$m with a view to preventing deterioration in image quality such as occurrence of carrier streaks. Actually, such materials are applicable as those known as electrophotographic two-component carriers, for example, metals such as ferrite, magnetite, iron, nickel, cobalt, alloys or mixtures of these metals with zinc, antimony, aluminium, lead, tin, bismuth, beryllium, manganese, selenium, tungsten, zirconium, vanadium, and the like; mixtures of those metals with metal oxides such as iron oxide, titanium oxide, and magnesium oxide, nitrides such as chromium nitride and vanadium nitride, or carbides such as silicon carbide and tungsten carbide, as well as ferromagnetic ferrites, and mixtures of these compounds.

The coating resin (electrical conductive layer, adhesive layer, surface protective layer) for these carrier core materials may be, for example, thermoplastic resins and thermosetting resins such as polystyrenic resins, poly(meth)acrylic resins, polyolefin resins, polyamide resins, polycarbonate resins, polyether resins, polysulfoacid resins, polyester resins, epoxy resins, polybutyral resins, uric resins, urethane/urea resins, silicone resins, and teflon resins, and their mixtures, and copolymers, block polymers, graft polymers, polymer blends, and the like of these resins.

The one-component developers are applied to, for example, a non-magnetic one-component developing apparatus or image forming method having a general construction as shown in FIG. 1.

Referring to FIG. 1, an electrostatic latent image-supporting member 1 (hereinafter, referred to as a photosensitive drum) has a photosensitive layer formed on an electrically conductive substrate, and is rotated in a direction of arrow in the figure.

A charging brush 2 as a charging member is provided so as to be in contact with the surface of the photosensitive drum 1. A specified charging voltage is applied to the charging brush 2 by a power supply 3, thereby the photosensitive drum 1 surface is charged to a specified polarity and surface voltage.

Then, an electrostatic latent image is formed by image exposure 4 on the photosensitive drum 1 surface charged to the specified voltage, and this electrostatic latent image is developed by a one-component developing apparatus 5 to form a toner image. Details of the one-component developing apparatus 5 will be described later.

A transfer roller 6 as a transfer member, having an electrically conductive elastic layer formed on the outer periphery of its core, is pressed at a specified pressure into contact with the photosensitive drum 1, thus rotating in a direction of arrow in the figure. Also, a bias voltage of a polarity opposite to the polarity to which the toner is charged is applied to the transfer roller 6 by a power supply 7. A transfer material 8 is conveyed to between the photosensitive drum 1 and the transfer roller 6, where the toner image on the photosensitive drum 1 is transferred onto the transfer material 8 under the aforementioned bias voltage.

The image forming apparatus including the step of electrostatically transferring the toner image formed on the latent image-supporting member surface onto a sheet transfer material (primarily given by paper) in the way as described above allows the area at which the transfer material is sucked to the latent image-supporting member, to be enlarged by adjusting the pressing force of the transfer roller against the latent image-supporting member, as compared with a conventional transfer means making use of corona discharge which have been widely used practically. Further, in the apparatus, since the transfer material is aggressively pressed and supported at the transfer site, transfer shifts due to synchronization faults of the transfer material conveying means as well as to loops and curls present in the transfer material are less likely to occur, while the demands for reduction in the transfer material conveying path as well as for reduction in the size of the latent image-supporting member, with the background of the trend toward the downsizing of the image forming apparatus, are more likely to be implemented.

On the other hand, in the apparatuses which carry out the image transfer by contact process, a transfer current is supplied from the contact site, so that a certain level of pressure needs to be applied to the transfer device. When contact pressure is applied, the toner image on the latent image-supporting member also has a pressure applied thereto, with a tendency that toner agglomeration is likely to occur.

Further, when the latent image-supporting member surface is formed from resin, there will occur adhesion also between the toner agglomerations and the latent image-supporting member. As a result, the toner is obstructed from moving toward the transfer material and, in extreme cases, portions with firm adhesion will not transfer at all, causing a larger possibility of a phenomenon that toner image may lack.

This phenomenon will be particularly considerable at portions of 0.1 to 2 mm wide lines. This is due to the fact that line portions are accompanied by edge development, where much toner is placed on so that toner agglomeration due to pressurization is likely to occur and therefore that image lacks due to transfer are likely to occur. In such a case, the toner image would result in a copy image of outlines of the image, called 'transfer hollowing'.

Figure 2:
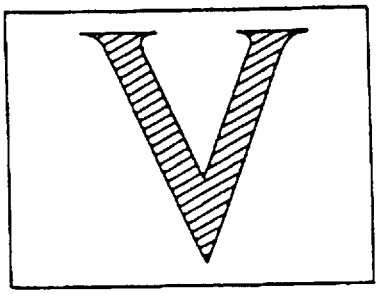
FIG. 2 is a view for explaining the hollowing phenomenon.
Figure 3:
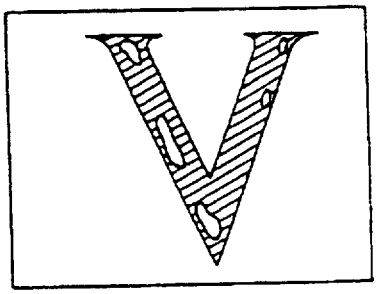
FIG. 3 is a view for explaining the hollowing phenomenon.

FIG. 2 illustrates an example of hollowing. In FIG. 2, a character "V" hatched on the left side is a character text with the hatched portion solid in black. An image copied from this text in which a hollowing phenomenon has occurred is the character "V" shown in FIG. 3. The hatched black solid portion has not been fully copied but a white hollow portion is formed. This is the hollowing phenomenon.

The 'transfer hollowing' is more noticeable when 100 g/cm$^2$ or thicker cardboards, OHP films with high smoothness, the second-surface copying in the duplex copy mode, and the like are used. This could be attributed to the fact that transfer material's large thickness of cardboards and OHP films results in less effect to the transfer electric field and that intense pressure applied makes the hollowing more likely to occur.

In the case of the second-surface copy in the two-side copy mode, it is considered that the releasing agent contained for prevention of offset adheres to the transfer material from the fixing unit when it passes through the fixing unit in the process of forming fixed images on the first-surface, and makes an obstacle for the close contact between toner and transfer material at the second-surface transfer process, thus making the hollowing more likely to occur.

However, according to the present invention, in an electrostatic latent image development method including such a contact transfer process, the hollowing phenomenon can be prevented by using a one-component developer to which laminated titanium oxide fine particles are externally added to a toner comprising at least a colorant and a binder resin.

Next, reverting again to FIG. 1, the subsequent process after the toner image on the photosensitive drum 1 has been transferred onto the transfer material 8 is described.

The transfer material 8, on the surface of which the toner image has been transferred, conveyed up to the fixing unit comprising a fixing roller pair 11 composed of a heating roller with a built-in heater contained inside and a press roller in press contact with the heating roller. Then, the transfer material 8 passes between the fixing roller pair 11, thereby the toner image carried on its surface is fixed.

The surface of the photosensitive drum 1, from which the toner image has been transferred to the transfer material 8, has foreign matters such as residual toner and paper powder removed by a cleaning unit 9 equipped with a cleaning blade, and then electrically erased through photo-radiation by an eraser unit 10. Thus, the surface of the photosensitive drum 1 is subjected to the next image-forming process.

The one-component developing apparatus 5 comprises a drive roller 21 which is driven into rotation in the direction of arrow in the figure by an unshown drive means. To this drive roller, externally fitted is a flexible developing sleeve 22 having an inner diameter slightly larger than the outer diameter of the drive roller. Both end portions of the developing sleeve 22 are pressed into contact with the drive roller 21 by a press guide 23 from the rear, while a flexed portion 30 formed on the opposite side by the press is in flexible contact with the electrostatic latent image-supporting member 1 (photosensitive drum). Further, a toner regulating blade 24 is in contact with the developing sleeve 22 from the same side as the press guide 23.

A buffer chamber 25 is provided behind the developing sleeve 22, and a toner feed chamber 26 is provided further behind. A toner feed rotating member 27 is placed in the buffer chamber 25, and a toner stir-and-feed rotating member 28 is placed in the toner feed chamber 26.

Further, a seal member 29 for preventing the toner from leaking from the buffer chamber 25 to outside is in contact with the lower surface of the developing sleeve 22.

According to this developing apparatus, non-magnetic one-component toner T fed from the toner feed chamber 26 into the buffer chamber 25 by the rotation of the rotating member 28 is fed to the surface of the developing sleeve 22 successively by the rotation of the toner feed rotating member 27.

Meanwhile, the developing sleeve 22 is subordinately rotated through frictional force by the drive rotation of the drive roller 21. The toner T fed to this developing sleeve 22 passes through between the toner regulating blade 24 and the sleeve 22, where the toner is thereby triboelectrically charged under a pressure of the blade 24 and formed into a specified thin layer. The resulting toner thin layer is retained on the surface of the developing sleeve 22, and conveyed to the developing area confronting the photosensitive drum 1, thus subjected to the development of an electrostatic latent image.

Excess toner remaining on the developing sleeve 22 after development is returned to the buffer chamber 25 by passing through between the seal member 29 and the developing sleeve 22 along with the rotation of the sleeve 22.

It is noted that the one-component developing apparatus to which the one-component developer of the present invention is applicable is not limited to the above-described example, but various types of apparatuses may be used. For example, whereas a developing sleeve 22 with an inner diameter larger than the outer diameter of the drive roller and with a flexed portion 30 formed therein has been used in the apparatus of FIG. 1, another construction without such a flexed portion, i.e., a developing sleeve having an inner diameter equal to the outer diameter of the drive roller may also be used.

Hereinbelow, the present invention will be described in more detail by referring to experimental examples. In the examples, the term "parts" refers to "parts by weight" unless otherwise specified. Toner Preparation Example 1

| | |
|---|---|
| Styrene - acrylic resin (acid value: 25, glass transition point (Tg): 60° C., softening point (Tm): 120° C.) | 100 parts |
| Charge controlling agent (Spilon Black TRH; made by Hodogaya Kagaku Kogyo K.K.) | 3 parts |
| Carbon black (Mogul L; made by Cabot K.K.) | 6 parts |
| Wax (Viscol 605P; made by Sanyo Kasei K.K.) | 5 parts |

The above mixture was well mixed by a Henschel mixer, and melt-kneaded by using a twin-screw extruder. The kneaded product was cooled and then coarsely pulverized. The coarsely pulverized product was finely pulverized by a pulverizer of air jet method. The finely pulverized product was further classified by an air stream type pulverizer, whereby a toner mother particle A with a volume average particle size ($D_{50}$) of 10.2 $\mu$m was obtained. Carrier Preparation Example 1

| | |
|---|---|
| Polyester resin (acid value: 15.0, Tg: 65° C., Tm: 120° C.) | 100 parts |
| Magnetic powder (MFP-2, made by TDK K.K.) | 400 parts |

By using the above materials, a binder type micro-carrier with a volume average particle size ($D_{50}$: 70 $\mu$m) was obtained in the same way as in the toner preparation process. This is assumed carrier A. The carrier A had a saturation magnetization of 56 emu/g and an electrical resistance of $7\times10^{12}$ Ω.cm.

EXAMPLE 1

Relative to 100 parts of particles obtained in the above toner preparation example, 1.0 part of hydrophobic laminated titania fine particles (particle size: 0.015 to 0.02 $\mu$m, STT-30A; made by Titan Kogyo K.K.) were added, and mixed by a Henschel mixer, whereby a toner was obtained.

Relative to 5 parts of the resulting toner, the carrier A was mixed so as to total 100 parts, whereby a developer was prepared.

The resulting developer was subjected to image forming process by a commercially available plain paper high-speed copying machine (EP-8600; made by Minolta Co., Ltd.) of the electrophotographic method, and further to a durability test of continuous 30,000 copies under the following environments Durability test Under an environment N/N (25° C., 45%) 10,000 copies Under an environment L/L (10° C., 15%) 10,000 copies Under an environment H/H (30° C., 85%) 10,000 copies The images after the durability tests under the individual environments were fog-free, clear, and good at image density, comparable to initial image density. Results are listed in Table 1. It is noted that the image density, fogging, and durability were evaluated by the following criteria:

Image density

Image density (I. D.) values were determined by rounding off the second decimal place.

Fogging

Obtained images were visually evaluated and ranked as follows:

⊙: Rank 5 (no fogging);

○: Rank 4 (almost no fogging);

Δ: Rank 3 (fogging slightly recognized, but no problem for practical use); and x: Ranks 1 to 2 (much fogging, problematic for practical use).

Durability

After 30,000 copies under the individual environments, the images were comprehensively evaluated and ranked as follows:

⊙: No problem;

○: Some characteristics have changed, but no problem for practical use;

Δ: Characteristic changes have occurred so that image quality after the 30,000 copy test are problematic for practical use; and x: No durable for 30,000 copies.

EXAMPLE 2

A developer was prepared by the same procedure as in Example 1, except that the addition amount of hydrophobic laminated titania fine particles (STT-30A; made by Titan Kogyo K.K.) was 0.5 part. Then, the developer characteristics were evaluated in the same way as in Example 1. Results are shown in Table 1.

EXAMPLE 3

A developer was prepared by the same procedure as in Example 1, except that the addition amount of hydrophobic laminated titania fine particles (STT-30A; made by Titan Kogyo K.K.) was 1.5 parts. Then, the developer characteristics were evaluated in the same way as in Example 1. Results are shown in Table 1.

Comparative Example 1

A developer was prepared by the same procedure as in Example 1, except that hydrophobic indefinite-shape particulate titania fine particles (T-805; made by Degussa Co.) instead of the laminated titania fine particles in Example 1 were added to 0.8 parts. Then, the developer characteristics were evaluated in the same way as in Example 1. Results are shown in Table 1.

Comparative Example 2

A developer was prepared by the same procedure as in Example 1, except that hydrophobic indefinite-shape particulate titania fine particles (TTO-51C; made by Ishihara Sangyo K.K.) instead of the laminated titania fine particles in Example 1 were added to 1.0 part. Then, the developer was tested, and results are shown in Table 1.

Comparative Example 3

Ilmenite ore was dissolved with sulfuric acid, cooled, and thereafter centrifugally separated. The centrifugally separated raw liquid was subjected to pyrolysis and hydrolysis, and the resulting titanium hydroxide was baked (350° to 400° C.) by a rotary kiln, whereby a spherical hydrophilic titanium oxide (particle size: 0.04 to 0.05 $\mu$m) was obtained.

While the titanium oxide obtained in this way was stirred and mixed in an aqueous system, a coupling agent ($n\text{-}C_5H_{11}Si(OCH_3)_3$) was added and mixed so as to meter 20% relative to the titanium oxide fine particles. The mixture was dried and crushed, whereby spherical titania fine particles with a hydrophobic ratio of 50% were obtained.

A developer was prepared by the same procedure as in Example 1, except that 1.0 part of the spherical titania fine particles thus obtained was used instead of the laminated titania fine particles. Then, the developer characteristics were evaluated in the same way as in Example 1. Results are shown in Table 1.

TABLE 1

| | Image density (ID) | | | Fogging | | | Dura- |
|---|---|---|---|---|---|---|---|
| | M/N | L/L | H/H | N/N | L/L | H/H | bility |
| Ex.* 1 | 1.4–1.5 | 1.4–1.5 | 1.4–1.5 | ⊙ | ⊙ | ⊙ | ⊙ |
| Ex. 2 | 1.4–1.5 | 1.4–1.5 | 1.4–1.5 | ⊙ | ⊙ | ⊙ | ⊙ |
| Ex. 3 | 1.4–1.5 | 1.4–1.5 | 1.4–1.5 | ⊙ | ⊙ | ○ | ⊙ |
| Comp. Ex.** 1 | 1.2–1.5 | 1.1–1.3 | 1.2–1.4 | Δ | Δ | X | X |
| Comp. Ex. 2 | 1.2–1.5 | 1.1–1.3 | 1.2–1.4 | Δ | Δ | X | X |
| Comp. Ex. 3 | 1.4–1.5 | 1.2–1.4 | 1.3–1.4 | ○ | ○ | Δ | X |

*Example, **Comparative Example

Toner Preparation Example 2

| | |
|---|---|
| Polyester resin (acid value: 8, glass transition point (Tg): 63° C., softening point (Tm): 105° C.) | 100 parts |
| Charge controlling agent (Bontron E-84; made by Orient Kagaku Kogyo K.K.) | 1 part |
| Brilliant carmine 6B | 4 parts |

The above mixture was well mixed by a Henschel mixer, and melt-kneaded by using a twin-screw extruder. The kneaded product was cooled and then coarsely pulverized. The coarsely pulverized product was finely pulverized by a pulverizer of the air jet method. The finely pulverized product was further classified by an air stream type pulverizer, whereby a toner mother particle B with a volume average particle size ($D_{50}$) of 8.0 $\mu$m was obtained.

Toner Preparation Example 3

| | |
|---|---|
| Polyester resin (acid value: 20, Tg: 60° C., softening point (Tm): 120° C.) | 100 parts |
| Charge controlling agent (Spilon Black TRH; made by Hodogaya Kagaku Kogyo K.K.) | 1 part |
| Carbon black (Mogul L; made by Cabot K.K.) | 8 parts |
| Wax (Viscol 605P; made by Sanyo Kasei K.K.) | 4 parts |

A toner mother particle C with a volume average particle size of 7.5 $\mu$m was obtained by the same procedure as in Toner Preparation Example 2, except that the above materials were used.

Toner Preparation Example 4

| | |
|---|---|
| Styrene - acrylic resin (acid value: 25, Tg: 60° C., Tm: 120° C.) | 100 parts |
| Charge controlling agent (Spilon Black TRH; made by Hodogaya Kagaku Kogyo K.K.) | 3 parts |
| Carbon black (MA#8; made by Mitsubishi Kagaku K.K.) | 6 parts |
| Wax (Viscol 605P; made by Sanyo Kasei K.K.) | 4 parts |

A toner mother particle D with a volume average particle size of 10.5 $\mu$m was obtained by the same procedure as in Toner Preparation Example 2, except that the above materials were used.

Toner Preparation Example 5

| | |
|---|---|
| Styrene - acrylic resin (acid value: 20, Tg: 60° C., Tm: 125° C.) | 100 parts |
| Charge controlling agent (Nigrosine Base EX; made by Orient Kagaku Kogyo K.K.) | 4 parts |
| Carbon black (Mogul L; made by Cabot K.K.) | 9 parts |
| Wax (Viscol 605P; made by Sanyo Kasei K.K.) | 4 parts |

A toner mother particle E with a volume average particle size of 11 $\mu$m was obtained by the same procedure as in Toner Preparation Example 2, except that the above materials were used.

Toner Preparation Example 6

| | |
|---|---|
| Polyester resin (Tg: 63° C., Tm: 120° C., gel component (THF insoluble component content): 33 wt %) | 100 parts |
| Charge controlling agent (Spilon Black TRH; made by Hodogaya Kagaku Kogyo K.K.) | 3 parts |
| Carbon black (MA-8; made by Mitsubishi Kagaku K.K.) | 10 parts |
| Offset inhibiting agent (TS-200; made by Sanyo Kasei K.K.) | 3 parts |

A toner mother particle F with a volume average particle size of 8.5 $\mu$m was obtained by the same procedure as in Toner Preparation Example 2, except that the above materials were used.

Toner Preparation Example 7

| | |
|---|---|
| Styrene | 60 parts |
| n-butyl methacrylate | 35 parts |
| Methacrylic acid | 5 parts |
| 2,2-azobis-(2,4-dimethylvaleronitrile) | 0.5 part |
| Low molecular weight polypropylene (Viscol 605P; made by Sanyo Kasei Kogyo K.K.) | 3 parts |
| Carbon black (MA-8; made by Mitsubishi Kagaku K.K.) | 8 parts |
| Salicylic acid metal complex (E-84; Orient Kagaku Kogyo K.K.) | 1 part |

The above materials were mixed by a sand stirrer, whereby a polymerizable composition was prepared. This composition was polymerized at a temperature of 60° C. for 60 hours while it was stirred in a 3% Arabia rubber aqueous solution at 4000 rpm by using a stirrer TK auto homomixer (made by Tokushu Kika Kogyo K.K.). Thus, spherical particles with a mean particle size of 6 $\mu$m was obtained. This spherical particle is assumed toner mother particle G.

Carrier Preparation Example 2

Eighty parts by weight of a styrene—acrylic copolymer composed of styrene, methylmethacrylate, 2-hydroxyethylacrylate, and methacrylic acid (1.5:7.0:1.0 : 0.5) and 20 parts by weight of butylated melamine resin were diluted with toluene, whereby a styrene—acryl resin solution with a solid ratio of 2% was obtained.

The styrene—acryl resin solution was applied to baked ferrite powder (F-300, mean particle size: 50 $\mu$m, made by Powdertech Co., Ltd.) as a core material, by a SPIRA COTA (made by Okada Seiko K.K.). Then, the ferrite powder coated with the resin solution was dried and thereafter allowed to stand in a hot air circulation type oven at 140° C. for 2 hours, thus being baked.

The baked ferrite powder bulk was cooled and then crushed by a sieve shaker equipped with 210 $\mu$m and 90 $\mu$m screen meshes, whereby a resin-coated ferrite powder was obtained.

The resulting ferrite powder was further subjected to the sequence of application, baking, and crushing processes as described above, each three times, whereby a resin-coated carrier was obtained. The mean particle size of the resulting carrier was 52 $\mu$m. This carrier is assumed carrier B.

Carrier Preparation Example 3

| | |
|---|---|
| Polyester resin (acid value: 15.0, Tg: 65° C., Tm: 120° C.) | 100 parts |
| Magnetic powder (MFP-2, made by TDK K.K.) | 500 parts |

By using the above materials, a carrier with volume average particle size ($D_{50}$) 70 μm, saturation magnetization 56 emu/g, and electrical resistance $7\times10^{12}$ Ω.cm was obtained by the same process as in Toner Preparation Example 1. This is assumed carrier C.

EXAMPLE 4

Relative to 100 parts of toner mother particles B, 0.6 parts of hydrophobic laminated titania fine particles (particle size: 0.015 to 0.02 μm, STT-30A; made by Titan Kogyo K.K.) and 0.6 parts of silica (H2000; made by Hoechst Co.) were added, and mixed by a Henschel mixer.

Relative to 5 parts of the resulting toner, to which laminated titania fine particles were externally added, the carrier B was added and mixed so as to total 100 parts, whereby a developer was prepared.

The developer obtained in this way was subjected to image forming process by a commercially available full-color copying machine (CF-80; made by Minolta Co., Ltd.), and further to a durability test of 5,000 copies under the following environments:

Durability test

Under an environment N/N (25° C., 45%) 5,000 copies

Under an environment L/L (10° C., 15%) 5,000 copies

Under an environment H/H (30° C., 85%) 5,000 copies

The images after the durability tests under the individual environments were fog-free, clear, and good at image density, comparable to initial image density. These results are listed in Table 4. It is noted that the image density, fogging, and durability tests were evaluated by the following criteria:

Image density (I. D.)

○: I. D. remains unchanged after continuous copying since initial copying; high density is maintained stably;

Δ: I. D. has changed after continuous copying since initial copying, but no problem for practical use; and x: I. D. has largely changed, compared with initial copying, problematic for practical use.

Fogging

○: No fogging in the initial copying or after continuous copying;

Δ: Slight fogging is recognized after continuous copying, but no problem for practical use; and x: Much fogging, problematic for practical use.

Durability

For durability, the images were comprehensively evaluated and ranked as follows:

○: A successful image is obtained even after continuous copying, just as it is in initial copying;

Δ: The image has changed after the continuous copying test, compared with initial copying, but no problem for practical use; and x: The image has largely changed after the continuous copying test, compared with initial copying, problematic for practical use.

It is noted that in the following Examples and Comparative Examples, none of the test pieces had any problem for practical use in initial stage.

EXAMPLE 5

A developer was prepared by the same procedure as in Example 4, except that 0.8 parts of hydrophobic laminated titania fine particles (STT-30A; made by Titan Kogyo K.K.) and 0.4 parts of silica (H2000; made by Hoechst Co.) were used as external additives, respectively, relative to 100 parts of toner mother particles B. Then, the developer characteristics were evaluated in the same way as in Example 4. Results are shown in Table 4.

EXAMPLE 6

A developer was prepared by the same procedure as in Example 4, except that 0.7 parts of hydrophobic laminated titania fine particles (STT-30A; made by Titan Kogyo K.K.) and 0.4 parts of silica (RX50A; made by Nippon Aerosil K.K.) were used as external additives, respectively, relative to 100 parts of toner mother particles B. Then, the developer characteristics were evaluated in the same way as in Example 4. Results are shown in Table 4.

EXAMPLE 7

A developer was prepared by the same procedure as in Example 4, except that 1.0 parts of hydrophobic laminated titania fine particles (STT-30A; made by Titan Kogyo K.K.) and 0.3 parts of resin beads (MP-1000; made by Soken Kagaku K.K.) were used as external additives, respectively, relative to 100 parts of toner mother particles B. Then, the developer characteristics were evaluated in the same way as in Example 4. Results are shown in Table 4.

EXAMPLE 8

A developer was prepared by the same procedure as in Example 4, except that 0.5 parts of hydrophobic laminated titania fine particles (STT-30A; made by Titan Kogyo K.K.), 0.4 parts of silica (H2000; made by Hoechst Co.), and 0.2 parts of resin beads (MP-1000; made by Soken Kagaku K.K.) were used as external additives, respectively, relative to 100 parts of toner mother particles B. Then, the developer characteristics were evaluated in the same way as in Example 4. Results are shown in Table 4.

EXAMPLE 9

A developer was prepared by the same procedure as in Example 4, except that 0.4 parts of hydrophobic laminated titania fine particles (STT-30A; made by Titan Kogyo K.K.), 0.4 parts of silica (H2000; made by Hoechst Co.), and 0.2 parts of alumina particles (RFY-C; made by Nippon Aerosil K.K.) were used as external additives, respectively, relative to 100 parts of toner mother particles B. Then, the developer were evaluated in the same way as in Example 4. Results are shown in Table 4.

EXAMPLE 10

Relative to 100 parts of toner mother particles C, 0.4 parts of hydrophobic laminated titania fine particles (particle size: 0.015 to 0.02 μm, STT-30A; made by Titan Kogyo K.K.) and 0.2 parts of silica (H2000; made by Hoechst Co.) were added, and mixed by a Henschel mixer.

Relative to 4 parts of the resulting toner, to which laminated titania fine particles were externally added, the carrier C was added and mixed so as to total 100 parts, whereby a developer was prepared.

The developer obtained in this way was subjected to image forming process by a commercially available digital copying machine (Di-30; made by Minolta Co., Ltd.), and further to a durability test of 15,000 copies under the aforementioned environments. Then, the developer characteristics were evaluated in the same way as in Example 4. Results are shown in Table 4.

EXAMPLE 11

A developer was prepared by the same procedure as in Example 10, except that 0.3 parts of hydrophobic laminated titania fine particles (STT-30A; made by Titan Kogyo K.K.), 0.2 parts of silica (H2000; made by Hoechst Co.), and 0.1 part of resin beads (MP-1000; made by Soken Kagaku K.K.) were used as external additives, respectively, relative to 100 parts of toner mother particles C. Then, the developer characteristics were evaluated in the same way as in Example 10. Results are shown in Table 4.

EXAMPLE 12

Relative to 100 parts of toner mother particles D, 0.4 parts of hydrophobic laminated titania fine particles (particle size: 0.015 to 0.02 $\mu$m, STT-30A; made by Titan Kogyo K.K.) and 0.2 parts of silica (H2000; made by Hoechst Co.) were added, and mixed by a Henschel mixer.

Relative to 5 parts of the resulting toner, to which laminated titania fine particles were externally added, the carrier C was added and mixed so as to total 100 parts, whereby a developer was prepared.

The developer obtained in this way was subjected to image forming process by a commercially available analog copying machine (EP-8600; made by Minolta Co., Ltd.), and further to a durability test of 15,000 copies under the aforementioned environments. Then, the developer characteristics were evaluated in the same way as in Example 4. Results are shown in Table 4.

EXAMPLE 13

A developer was prepared by the same procedure as in Example 12, except that 0.4 parts of hydrophobic laminated titania fine particles (STT-30A; made by Titan Kogyo K.K.), 0.2 parts of silica (RX50A; made by Nippon Aerosil K.K.), and 0.1 part of resin beads (MP-1000; made by Soken Kagaku K.K.) were used as external additives, respectively, relative to 100 parts of toner mother particles D. Then, the developer characteristics were evaluated in the same way as in Example 12. Results are shown in Table 4.

EXAMPLE 14

A developer was prepared by the same procedure as in Example 12, except that 0.3 parts of hydrophobic laminated titania fine particles (STT-30A; made by Titan Kogyo K.K.), 0.1 parts of alumina particles (RFY-C; made by Nippon Aerosil K.K.), and 0.2 parts of silica (H2000; made by Hoechst Co.) were used as external additives, respectively, relative to 100 parts of toner mother particles D. Then, the developer characteristics were evaluated in the same way as in Example 12. Results are shown in Table 4.

EXAMPLE 15

Relative to 100 parts of toner mother particles E, 0.3 parts of hydrophobic laminated titania fine particles (particle size: 0.015 to 0.02 $\mu$m, STT-30A; made by Titan Kogyo K.K.) and 0.3 parts of silica (R-972; made by Nippon Aerosil K.K.) were added, and mixed by a Henschel mixer.

Relative to 8 parts of the resulting toner, to which laminated titania fine particles were externally added, the carrier C was added and mixed so as to total 100 parts, whereby a developer was prepared.

The developer obtained in this way was subjected to image forming process by a commercially available analog copying machine (EP-9765; made by Minolta Co., Ltd.), and further to a durability test of 15,000 copies under the aforementioned environments. Then, the developer characteristics were evaluated in the same way as in Example 4. Results are shown in Table 4.

EXAMPLE 16

Relative to 100 parts of toner mother particles F, 0.4 parts of hydrophobic laminated titania fine particles (particle size: 0.015 to 0.02 $\mu$m, STT-30A; made by Titan Kogyo K.K.) and 0.2 parts of silica (H2000; made by Hoechst Co.) were added, and mixed by a Henschel mixer, whereby a one-component developer was prepared.

This developer was subjected to image forming process by a commercially available electrophotographic printer (SP1000; made by Minolta Co., Ltd.) of the one-component development method, and further to a durability test of 500 copies under the aforementioned environments. Then, the developer characteristics were evaluated in the same way as in Example 4. Results are shown in Table 4.

EXAMPLE 17

Relative to 100 parts of toner mother particles G, 0.4 parts of hydrophobic laminated titania fine particles (particle size: 0.015 to 0.02 $\mu$m, STT-30A; made by Titan Kogyo K.K.) and 0.2 parts of silica (H2000; made by Hoechst Co.) were added, and mixed by a Henschel mixer.

Relative to 4 parts of the resulting toner, to which laminated titania fine particles were externally added, the carrier C was added and mixed so as to total 100 parts, whereby a developer was prepared.

The developer obtained in this way was subjected to image forming process by a commercially available digital copying machine (Di-30; made by Minolta Co., Ltd.), and further to a durability test of 15,000 copies under the aforementioned environments. Then, the developer characteristics were evaluated in the same way as in Example 4. Results are shown in Table 4.

Comparative Example 4

A developer was prepared by the same procedure as in Example 4, except that generally spherical titania (T-805; made by Degussa K.K.) was used instead of the hydrophobic laminated titania fine particles (STT-30A; made by Titan Kogyo K.K.) in the same amount. Then, the developer characteristics were evaluated in the same way as in Example 4. Results are shown in Table 4.

Comparative Example 5

Ilmenite ore was dissolved with sulfuric acid, cooled, and thereafter centrifugally separated. The centrifugally separated raw liquid was subjected to pyrolysis and hydrolysis, and the resulting titanium hydroxide was baked (400° to 500° C.) by a rotary kiln, whereby a spherical hydrophilic titanium oxide (particle size: 0.04 to 0.05 $\mu$m) was obtained.

While the titanium oxide obtained in this way was stirred and mixed in an aqueous system, a coupling agent ($n\text{-}C_5H_{11}Si(OCH_3)_3$) was added and mixed so as to meter 20% relative to the titanium oxide fine particles. The mixture was dried and crushed, whereby spherical titanium oxide fine particles with a hydrophobic ratio of 50% were obtained.

A developer was prepared by the same procedure as in Example 4, except that 0.6 parts of the spherical titanium oxide fine particles thus obtained was used instead of 0.6 parts of the laminated titania fine particles. Then, the developer characteristics were evaluated in the same way as in Example 4. Results are shown in Table 4.

Comparative Example 6

A developer was prepared by the same procedure as in Example 6, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 4. Results are shown in Table 4.

Comparative Example 7

A developer was prepared by the same procedure as in Example 8, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 4. Results are shown in Table 4.

Comparative Example 8

A developer was prepared by the same procedure as in Example 9, except that the spherical titanium oxide fine particles prepared in Comparative Example 5 were used instead of the hydrophobic laminated titania fine particles in the same amount. Then, the developer characteristics were evaluated in the same way as in Example 4. Results are shown in Table 4.

Comparative Example 9

A developer was prepared by the same procedure as in Example 11, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 4. Results are shown in Table 4.

Comparative Example 10

A developer was prepared by the same procedure as in Example 14, except that the spherical titanium oxide fine particles prepared in Comparative Example 5 were used instead of the hydrophobic laminated titania fine particles in the same amount. Then, the developer characteristics were evaluated in the same way as in Example 4. Results are shown in Table 4.

Comparative Example 11

A developer was prepared by the same procedure as in Example 15, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 4. Results are shown in Table 4.

Comparative Example 12

A developer was prepared by the same procedure as in Example 16, except that the spherical titanium oxide fine particles prepared in Comparative Example 5 were used instead of the hydrophobic laminated titania fine particles in the same amount. Then, the developer characteristics were evaluated in the same way as in Example 4. Results are shown in Table 4.

Comparative Example 13

A developer was prepared by the same procedure as in Example 17, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 4. Results are shown in Table 4.

With respect to Examples 4 to 17 and Comparative Examples 4 to 13 as described above, the types of toner mother particles, types of titania, other external additives, types of carriers, addition amounts of toner to carrier (T/C (wt %)), and types of image forming apparatuses used for evaluation are listed in Tables 2 and 3.

In addition, in Tables 2 and 3, $T_1$ denotes laminated titania fine particles (STT-30A; made by Titan Kogyo K.K.), $T_3$ denotes generally spherical titania fine particles (T-805; made by Degussa K.K.), $T_4$ denotes spherical titania fine particles prepared by the method described in Comparative Example 2, $A_1$ denotes alumina fine particles (RFY-C; made by Nippon Aerosil K.K.), $B_1$ denotes resin beads (MP-1000; made by Soken Kagaku K.K.), $S_1$ denotes silica fine particles (H2000; made by Hoechst Co.), $S_2$ denotes silica fine particles (RX50A; made by Nippon Aerosil K.K.), and $S_3$ denotes silica fine particles (R-972; made by Nippon Aerosil K.K.).

TABLE 2

| | Toner | | | | | |
|---|---|---|---|---|---|---|
| Example | Type of toner mother particle | Type of titania (Number of added parts) | Other external additives (Number of added parts) | Type of carrier | T/C (%) | Evaluation machine (made by Minolta) |
| 4 | B | $T_1$ (0.6) | $S_1$ (0.6) | B | 5 | Full-color, CF-80 |
| 5 | B | $T_1$ (0.8) | $S_1$ (0.4) | B | 5 | Full-color, CF-80 |
| 6 | B | $T_1$ (0.7) | $S_2$ (0.4) | B | 5 | Full-color, CF-80 |
| 7 | B | $T_1$ (1.0) | $B_1$ (0.3) | B | 5 | Full-color, CF-80 |
| 8 | B | $T_1$ (0.5) | $S_1$ $B_1$ (0.4) (0.2) | B | 5 | Full-color, CF-80 |
| 9 | B | $T_1$ (0.4) | $A_1$ $S_1$ (0.2) (0.4) | B | 5 | Full-color, CF-80 |
| 10 | C | $T_1$ (0.4) | $S_1$ (0.2) | C | 4 | Digital, Di-30 |
| 11 | C | $T_1$ (0.3) | $S_1$ $B_1$ (0.2) (0.1) | C | 4 | Digital, Di-30 |
| 12 | D | $T_1$ (0.4) | $S_1$ (0.2) | C | 5 | Analog, EP-8600 |
| 13 | D | $T_1$ (0.4) | $S_2$ $B_1$ (0.2) (0.1) | C | 5 | Analog, EP-8600 |
| 14 | D | $T_1$ (0.3) | $A_1$ $S_1$ (0.1) (0.2) | C | 5 | Analog, EP-8600 |
| 15 | E | $T_1$ (0.3) | $S_3$ (0.3) | C | 8 | Analog, EP-9765 |
| 16 | F | $T_1$ (0.4) | $S_1$ (0.2) | — | — | SP1000 |
| 17 | G | $T_1$ (0.4) | $S_1$ (0.2) | C | 4 | Di-30 |

TABLE 3

| Comparative Example | Toner: Type of toner mother particle | Toner: Type of titania (Number of added parts) | Toner: Other external additives (Number of added parts) | Type of carrier | T/C (%) | Evaluation machine (made by Minolta) |
|---|---|---|---|---|---|---|
| 4 | B | $T_3$ (0.6) | $S_1$ (0.6) | B | 5 | Full-color, CF-80 |
| 5 | B | $T_4$ (0.6) | $S_1$ (0.6) | B | 5 | Full-color, CF-80 |
| 6 | B | $T_3$ (0.7) | $S_2$ (0.4) | B | 5 | Full-color, CF-80 |
| 7 | B | $T_3$ (0.5) | $S_1$ $B_1$ (0.4) (0.2) | B | 5 | Full-color, CF-80 |
| 8 | B | $T_4$ (0.4) | $A_1$ $S_1$ (0.2) (0.4) | B | 5 | Full-color, CF-80 |
| 9 | C | $T_3$ (0.3) | $S_1$ $B_1$ (0.2) (0.1) | B | 4 | Digital, Di-30 |
| 10 | D | $T_4$ (0.3) | $A_1$ $S_1$ (0.1) (0.2) | B | 5 | Analog, EP-8600 |
| 11 | E | $T_3$ (0.3) | $S_3$ (0.3) | B | 8 | Analog, EP-9765 |
| 12 | F | $T_4$ (0.4) | $S_1$ (0.2) | — | — | SP1000 |
| 13 | G | $T_3$ (0.4) | $S_1$ (0.2) | C | 4 | Di-30 |

TABLE 4

Results of Evaluation

| | Ground fogging | | | Image density (I.D.) | | | Durability (comprehensive evaluation) |
|---|---|---|---|---|---|---|---|
| | N/N | H/H | L/L | N/N | H/H | L/L | |
| Ex. 4 | ○ | ○ | ○ | ○ | ○ | ○ | ○ |
| Ex. 5 | ○ | ○ | ○ | ○ | ○ | ○ | ○ |
| Ex. 6 | ○ | ○ | ○ | ○ | ○ | ○ | ○ |
| Ex. 7 | Δ | ○ | ○ | ○ | ○ | ○ | ○ |
| Ex. 8 | ○ | Δ | ○ | ○ | ○ | Δ | Δ |
| Ex. 9 | Δ | Δ | ○ | Δ | Δ | ○ | Δ |
| Ex. 10 | ○ | ○ | ○ | ○ | ○ | ○ | ○ |
| Ex. 11 | ○ | ○ | ○ | ○ | ○ | ○ | Δ |
| Ex. 12 | ○ | ○ | ○ | ○ | ○ | ○ | ○ |
| Ex. 13 | ○ | Δ | Δ | ○ | Δ | Δ | Δ |
| Ex. 14 | Δ | Δ | ○ | Δ | Δ | ○ | Δ |
| Ex. 15 | Δ | ○ | ○ | ○ | ○ | Δ | Δ |
| Ex. 16 | ○ | ○ | ○ | ○ | ○ | ○ | ○ |
| Ex. 17 | ○ | ○ | Δ | ○ | Δ | Δ | Δ |
| Comp. Ex. 4 | ○ | X | Δ | ○ | X | X | X |
| Comp. Ex. 5 | ○ | X | ○ | ○ | ○ | Δ | X |
| Comp. Ex. 6 | Δ | X | X | Δ | X | X | X |
| Comp. Ex. 7 | ○ | Δ | Δ | ○ | X | Δ | X |
| Comp. Ex. 8 | ○ | X | Δ | ○ | Δ | ○ | X |
| Comp. Ex. 9 | Δ | X | X | Δ | X | X | X |
| Comp. Ex. 10 | ○ | X | Δ | ○ | X | ○ | X |
| Comp. Ex. 11 | ○ | ○ | X | ○ | ○ | X | X |
| Comp. Ex. 12 | ○ | ○ | X | ○ | ○ | X | X |
| Comp. Ex. 13 | Δ | X | X | Δ | X | X | X |

Toner Preparation Example 8

| | |
|---|---|
| Polyester resin (glass transition point (Tg): 63° C., softening point (Tm): 150° C., gel component: 33 wt %) | 100 parts |
| Charge controlling agent (Spilon Black TRH; made by Hodogaya Kagaku Kogyo K.K.) | 3 parts |
| Carbon black (MA-8; made by Mitsubishi Kagaku K.K.) | 10 parts |
| Offset inhibiting agent (TS-200; made by Mitsubishi Kasei K.K.) | 5 parts |

The above mixture was well mixed by a Henschel mixer, and melt-kneaded by using a twin-screw extruder. The kneaded product was cooled and then coarsely pulverized. The coarsely pulverized product was finely pulverized by a pulverizer of the air jet method. The finely pulverized product was further classified by an air stream type pulverizer, whereby a toner mother particle H with a volume average particle size of 8.5 μm was obtained.

EXAMPLE 18

Relative to 100 parts of toner mother particles H, 1.0 part of hydrophobic laminated titania fine particles (particle size: 0.015 to 0.02 μm, STT-30A; made by Titan Kogyo K.K.) was added, and mixed by a Henschel mixer, whereby a one-component developer was prepared.

The developer obtained in this way was subjected to image forming process by a commercially available electrophotographic printer (SP1000; made by Minolta Co., Ltd.) of the one-component development method, and further to a durability test of 3,000 copies under the following environments.

Durability test

Under an environment N/N (25° C., 45%) 3,000 copies

Under an environment L/L (10° C., 15%) 3,000 copies

Under an environment H/H (30° C., 85%) 3,000 copies

The images after the durability tests under the individual environments were fog-free, clear, and good at image density, comparable to initial image density. They were also completely free from occurrence of hollowing. Results of these evaluations are listed in Table 5. It is noted that the image density, fogging, and durability were evaluated by the following criteria:

Image density (I. D.)

Density (I. D.) of a black solid image was determined at initial stage and at the end of the durability test (3,000 copies). The resulting I. D. values were ranked "0" for 1.4 or more, "Δ" for not less than 1.3 and less than 1.4, and "x" for less than 1.3.

Fogging

The fogging was ranked "O" for cases where almost no fogging has occurred at initial stage or at the end of the durability test (3,000 copies), "Δ" for cases where slight fogging has occurred but no problem for practical use, and "x" for cases where much fogging has occurred problematic for practical use.

hollowing

The hollowing was ranked "O" for cases where almost no hollowing has occurred at initial stage or at the end of the durability test (3,000 copies), "Δ" for cases where hollowing has slightly occurred but no problem for practical use, and "x" for faulty cases.

EXAMPLE 19

A developer was prepared by the same procedure as in Example 18, except that the addition amount of hydrophobic laminated titania fine particles was 0.5 part. Then, the developer characteristics were evaluated in the same way as in Example 18. Results are shown in Table 5.

EXAMPLE 20

A developer was prepared by the same procedure as in Example 18, except that the addition amount of hydrophobic laminated titania fine particles was 1.2 parts. Then, the developer characteristics were evaluated in the same way as in Example 18. Results are shown in Table 5.

COMPARATIVE EXAMPLE 14

A developer was prepared by the same procedure as in Example 18, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 18. Results are shown in Table 5.

COMPARATIVE EXAMPLE 15

A developer was prepared by the same procedure as in Example 18, except that hydrophobic indefinite-shape particulate titania fine particles (TTO-51C; made by Ishihara Sangyo K.K.) were used instead of the hydrophobic laminated titania fine particles in the same amount. Then, the developer characteristics were evaluated in the same way as in Example 18. Results are shown in Table 5.

COMPARATIVE EXAMPLE 16

Ilmenite ore was dissolved with sulfuric acid, cooled, and thereafter centrifugally separated. The centrifugally separated raw liquid was subjected to pyrolysis and hydrolysis, and the resulting titanium hydroxide was baked (350° to 400° C.) by a rotary kiln, whereby a spherical hydrophilic titanium oxide (particle size: 0.04 to 0.05 $\mu$m) was obtained.

While the titanium oxide obtained in this way was stirred and mixed in an aqueous system, a coupling agent ($n\text{-}C_5H_{13}Si(OCH_3)_3$) was added and mixed so as to meter 20% relative to the titanium oxide fine particles. The mixture was dried and crushed, whereby spherical titanium oxide fine particles with a hydrophobic ratio of 50% were obtained.

A developer was prepared by the same procedure as in Example 18, except that the spherical titanium oxide fine particles thus obtained was used instead of the hydrophobic laminated titania fine particles in the same amount. Then, the developer characteristics were evaluated in the same way as in Example 18. Results are shown in Table 5.

TABLE 5

| | N/N | | | L/L | | | H/H | | |
|---|---|---|---|---|---|---|---|---|---|
| | Fogging | I.D. | Hollowing | Fogging | I.D. | Hollowing | Fogging | I.D. | Hollowing |
| Ex. 18 | ○ | ○ | ○ | ○ | ○ | ○ | ○ | ○ | ○ |
| Ex. 19 | ○ | ○ | Δ | ○ | Δ | Δ | ○ | ○ | Δ |
| Ex. 20 | Δ | ○ | ○ | Δ | ○ | ○ | Δ | ○ | ○ |
| Comp. Ex. 14 | Δ | Δ | Δ | ○ | X | Δ | X | X | Δ |
| Comp. Ex. 15 | Δ | Δ | Δ | Δ | X | Δ | X | X | Δ |
| Comp. Ex. 16 | ○ | ○ | Δ | Δ | Δ | Δ | X | X | Δ |

Toner Preparation Example 9

| | |
|---|---|
| Polyester resin (number average molecular weight (Mn): 5,000, weight average molecular weight (Mw): 10,000, Mw/Mn: 2.0, softening point (Tm): 105° C., glass transition point: 60° C., THF insoluble component: 0%) | 100 parts |
| Charge controlling agent (Bontron E-84; made by Orient Kagaku Kogyo K.K.) | 1 part |
| Brilliant carmine 6B | 4 parts |

The above mixture was well mixed by a Henschel mixer, and melt-kneaded by using a twin-screw extruder. The kneaded product was cooled and then coarsely pulverized. The coarsely pulverized product was finely pulverized by a pulverizer of the air jet method. The finely pulverized product was further classified by an air stream type pulverizer, whereby a toner mother particle I with a volume average particle size ($D_{50}$) of 8.0 $\mu$m was obtained.

EXAMPLE 21

Relative to 100 parts of toner mother particles I, 1.0 part of hydrophobic laminated titania fine particles (particle size: 0.015 to 0.02 $\mu$m, STT-30A; made by Titan Kogyo K.K.) was added, and mixed by a Henschel mixer.

Relative to 5 parts of the resulting toner, to which laminated titania fine particles were externally added, the carrier B was added and mixed so as to total 100 parts, whereby a developer was prepared.

The developer obtained in this way was subjected to image forming process by a commercially available full-color copying machine (CF-80; made by Minolta Co., Ltd.), and further to a durability test of 5,000 copies under the following environments:

Durability test

Under an environment N/N (25° C., 45%) 5,000 copies

Under an environment L/L (10° C., 15%) 5,000 copies

Under an environment H/H (30° C., 85%) 5,000 copies

The images after the durability tests under the individual environments were fog-free, clear, and good at image density, comparable to initial image density. Results of these evaluations are listed in Table 6. It is noted that the image density, fogging, and durability were evaluated by the following criteria:

Image density

Image density (I. D.) values were determined by rounding off the third decimal place.

Fogging

Obtained images were evaluated by comparing them with Minolta critical samples, and ranked as follows:

◎: Rank 5 (no fogging);

○: Rank 4 (almost no fogging);

Δ: Rank 3 (fogging slightly recognized, but no problem for practical use); and x: Ranks 1 to 2 (much fogging, problematic for practical use).

Durability

After 5,000 copy durability tests under the individual environments, the images were comprehensively evaluated and ranked as follows:

◎: No problem;

○: Some characteristics have changed, but no problem for practical use;

x: Problematic for practical use.

Light-transmittancy

Images were formed on a transparent sheet for use in over head projectors. Light-transparency of the images was visually observed, and ranked as follows:

○: No problem for practical use; and x: Impermissible for practical use.

EXAMPLE 22

A developer was prepared by the same procedure as in Example 21, except that the addition amount of hydrophobic laminated titania fine particles was 0.6 parts. Then, the developer characteristics were evaluated in the same way as in Example 21. Results are shown in Table 6.

EXAMPLE 23

A developer was prepared by the same procedure as in Example 21, except that the addition amount of hydrophobic laminated titania fine particles was 1.5 parts. Then, the developer characteristics were evaluated in the same way as in Example 21. Results are shown in Table 6.

Comparative Example 17

A developer was prepared by the same procedure as in Example 21, except that hydrophobic indefinite-shape particulate titania fine particles (T-805; made by Degussa K.K.) were used instead of the hydrophobic laminated titania fine particles in the same amount. Then, the developer characteristics were evaluated in the same way as in Example 21. Results are shown in Table 6.

Comparative Example 18

A developer was prepared by the same procedure as in Example 21, except that hydrophobic indefinite-shape particulate titania fine particles (TTO-51C; made by Ishihara Sangyo K.K.) were used instead of the hydrophobic laminated titania fine particles in the same amount. Then, the developer characteristics were evaluated in the same way as in Example 21. Results are shown in Table 6.

Comparative Example 19

Ilmenite ore was dissolved with sulfuric acid, cooled, and thereafter centrifugally separated. The centrifugally separated raw liquid was subjected to pyrolysis and hydrolysis, and the resulting titanium hydroxide was baked (350° to 400° C.) by a rotary kiln, whereby a spherical hydrophilic titanium oxide (particle size: 0.04 to 0.05 $\mu$m) was obtained.

While the titanium oxide obtained in this way was stirred and mixed in an aqueous system, a coupling agent ($n\text{-}C_5H_{11}Si(OCH_3)_3$) was added and mixed so as to meter 20% relative to the titanium oxide fine particles. The mixture was dried and crushed, whereby spherical titanium oxide fine particles with a hydrophobic ratio of 50% were obtained.

A developer was prepared by the same procedure as in Example 21, except that the spherical titanium oxide fine particles thus obtained were used instead of the laminated titania fine particles in the same amount. Then, the developer characteristics were evaluated in the same way as in Example 21. Results are shown in Table 6.

TABLE 6

| | Image density (I.D.) | | | Fogging | | | Dura- | OHP trans- |
|---|---|---|---|---|---|---|---|---|
| | N/N | L/L | H/H | N/N | L/L | H/H | bility | mittancy |
| Ex. 21 | 1.41–1.46 | 1.40–1.46 | 1.40–1.42 | ⊙ | ⊙ | ⊙ | ⊙ | ○ |
| Ex. 22 | 1.40–1.44 | 1.38–1.44 | 1.40–1.44 | ⊙ | ○ | ○ | ○ | ○ |
| Ex. 23 | 1.40–1.46 | 1.40–1.46 | 1.30–1.41 | ○ | ○ | Δ | ○ | ○ |
| Comp. Ex. 17 | 1.30–1.45 | 1.12–1.40 | 1.10–1.38 | Δ | X | X | X | ○ |
| Comp. Ex. 18 | 1.30–1.45 | 1.15–1.38 | 1.10–1.40 | Δ | X | X | X | ○ |
| Comp. Ex. 19 | 1.38–1.44 | 1.27–1.44 | 1.10–1.35 | Δ | Δ | X | X | ○ |

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A developer for developing an electrostatic latent image comprising:

toner particles comprising a colorant and a binder resin; and laminated titanium oxide particles adhered to surface of the toner, said titanium oxide particles having an average particle size of 5 to 40 nm.

2. The developer as claimed in claim 1 wherein said titanium oxide particles are produced in a wet process.

3. The developer as claimed in claim 1 wherein said titanium oxide particles are treated with a hydrophobic property imparting agent.

4. The developer as claimed in claim 3 wherein said titanium oxide particles are treated with a hydrophobic property imparting agent in an aqueous medium.

5. The developer as claimed in claim 1 wherein said toner particles comprise 0.01 to 10 percent by weight of a charge controlling agent relative to the binder resin of the toner.

6. The developer as claimed in claim 6 wherein said toner particles comprise 0.05 to 2 percent by weight of a charge controlling agent fixed on the surface thereof.

7. The developer as claimed in claim 1 wherein said toner particles comprise 0.1 to 10 percent by weight of off set preventing agent relative to the binder resin of the toner.

8. The developer as claimed in claim 1 wherein said titanium oxide particles are contained in an amount of 0.3 to 1.7 percent by weight on the basis of the toner particles.

9. The developer as claimed in claim 1, wherein the titanium oxide particles have the average particle size of 5 to 30 nm.

10. A developer for developing an electrostatic latent image comprising:

toner particles comprising a colorant and a polyester resin having a number average molecular weight (Mn) of 3,000 to 10,000, a weight average molecular weight (Mw) of 7,000 to 50,000, a molecular weight distribution (Mw/Mn) of 1.5 to 5.0, a glass transition point of 50° C. to 70° C. and a softening point of 90° to 110° C.; and laminated titanium oxide particles adhered to surface of the toner, said titanium oxide particles having an average particle size of 5 to 40 nm.

11. The developer as claimed in claim 10 wherein said polyester resin has the number average molecular weight (Mn) of 3,000 to 7,000, the weight average molecular weight (Mw) of 7,000 to 15,000, the molecular weight distribution (Mw/Mn) of 2.0 to 4.0.

12. The developer as claimed in claim 10 wherein said polyester resin is a linear polyester resin.

13. The developer as claimed in claim 12 wherein said polyester resin comprises a tetrahydrofuran-soluble component.

14. The developer as claimed in claim 10 wherein said titanium oxide particles are produced in a wet process.

15. The developer as claimed in claim 14 wherein said titanium oxide particles are contained in an amount of 0.5 to 2.0 percent by weight on the basis of the toner particles.

16. The developer as claimed in claim 10 wherein said titanium oxide particles are treated with a hydrophobic property imparting agent.

17. The developer as claimed in claim 10 which further comprises carrier particles, said carrier particles comprising resin-coated magnetic particles and said carrier particles having an average particle size of 20 to 100 $\mu$m.

18. The developer as claimed in claim 10, wherein the titanium oxide particles have the average particle size of 5 to 30 nm.

19. A monocomponent developer for developing an electrostatic latent image comprising:

toner particles comprising a colorant and a binder resin; and laminated titanium oxide particles adhered to the surface of the toner, said titanium oxide particles having an average particle size of 5 to 40 nm.

20. The monocomponent developer as claimed in claim 19 wherein said binder resin comprises a polyester resin having a glass transition point of 60° C. to 80° C. and a softening point of 110° C. to 170° C.

21. The monocomponent developer as claimed in claim 20 wherein said polyester resin contains 10 to 40 percent by weight of a solvent-insoluble component.

22. The monocomponent developer as claimed in claim 19 wherein said titanium oxide particles are produced in a wet process.

23. The monocomponent developer as claimed in claim 22 wherein said titanium oxide particles are contained in an amount of 0.3 to 1.7 percent by weight on the basis of the toner particles.

24. The monocomponent developer as claimed in claim 19 wherein said titanium oxide particles are treated with a hydrophobic property imparting agent.

25. The monocomponent developer as claimed in claim 19, wherein the titanium oxide particles have the average particle size of 5 to 30 nm.

26. A developer for developing an electrostatic latent image comprising:

toner particles comprising a colorant and a binder resin;

a first external additive comprising laminated titanium oxide particles having an average particle size of 5 to 40 nm; and a second external additive.

27. The developer as claimed in claim 26 wherein said titanium oxide particles are produced in a wet process.

28. The developer as claimed in claim 26 wherein said titanium oxide particle is treated with a hydrophobic property imparting agent.

29. The developer as claimed in claim 26 wherein said second external additive comprises particles selected from the group consisting of silica, titanium oxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate and zinc stearate.

30. The developer as claimed in claim 29 wherein said second external additive is treated with a hydrophobic property imparting agent.

31. The developer as claimed in claim 26 wherein said second external additive comprises resin particles selected from the group consisting of styrenic resin, acrylic resin, methacrylic resin, benzoguanamine resin, silicone resin, tetrafluoroethylene resin, polyethylene resin and polypropylene resin.

32. The developer as claimed in claim 26 wherein said first external additive is contained in an amount of 0.3 to 1.5 percent by weight on the basis of the toner particles.

33. The developer as claimed in claim 32 wherein said total amount of the first and second external additive is in the range of 0.4 to 3.0 percent by weight on the basis of the toner particles.

34. The developer as claimed in claim 26, wherein the titanium oxide particles have the average particle size of 5 to 30 nm.

* * * * *

UNITED STATES PATENT AND TRADEMARK OFFICE

CERTIFICATE OF CORRECTION

PATENT NO. : 5,840,458

DATED : November 24, 1998

INVENTOR(S) : Kenichi KIDO et al.

It is certified that error appears in the above-identified patent and that said Letters Patent is hereby corrected as shown below:

Col. 28, line 44, delete "6" and insert --5--.

Signed and Sealed this

Thirteenth Day of July, 1999

*Attest:*

*Attesting Officer*

Q. TODD DICKINSON

*Acting Commissioner of Patents and Trademarks*